US007475923B2

(12) United States Patent
Ottino et al.

(10) Patent No.: US 7,475,923 B2
(45) Date of Patent: Jan. 13, 2009

(54) VEHICLE DOOR LOCK

(75) Inventors: Franco Giovanni Ottino, S. Giuliano Terme (IT); Luca Bigazzi, Ponsacco (IT)

(73) Assignee: Intier Automotive Closures S.p.A., Cascine Vica Rivoli (IT)

( * ) Notice: Subject to any disclaimer, the term of this patent is extended or adjusted under 35 U.S.C. 154(b) by 0 days.

(21) Appl. No.: 11/435,180

(22) Filed: May 16, 2006

(65) Prior Publication Data

US 2006/0279090 A1 Dec. 14, 2006

Related U.S. Application Data

(60) Provisional application No. 60/681,486, filed on May 16, 2005.

(51) Int. Cl.
*E05C 3/06* (2006.01)

(52) U.S. Cl. ..... 292/216; 292/DIG. 56

(58) Field of Classification Search ..... 292/216, 292/DIG. 56

See application file for complete search history.

(56) References Cited

U.S. PATENT DOCUMENTS

| | | | | |
|---|---|---|---|---|
| 5,236,234 | A | 8/1993 | Norman | |
| 5,632,517 | A * | 5/1997 | Paulik et al. | 292/341.12 |
| 5,642,636 | A * | 7/1997 | Mitsui | 70/237 |
| 5,649,726 | A | 7/1997 | Rogers, Jr. et al. | |
| 6,007,118 | A | 12/1999 | Arabia, Jr. et al. | |
| 6,733,052 | B2 | 5/2004 | Perkins et al. | |
| 6,749,234 | B2 | 6/2004 | Bruce | |
| 6,789,825 | B2 * | 9/2004 | Kalargeros et al. | 292/216 |
| 7,188,872 | B2 * | 3/2007 | Kalargeros et al. | 292/216 |
| 2003/0222462 | A1 | 12/2003 | Bruce | |
| 2005/0073156 | A1 | 4/2005 | Oh | |

FOREIGN PATENT DOCUMENTS

| | | |
|---|---|---|
| DE | 10216313 | 10/2003 |
| EP | 1136640 A1 | 9/2001 |
| JP | 04143390 | 5/1992 |

OTHER PUBLICATIONS

English Abstract of DE 10216313. English Abstract of JP 04143390.

* cited by examiner

*Primary Examiner*—Gary Estremsky
(74) *Attorney, Agent, or Firm*—Clark Hill PLC

(57) ABSTRACT

A vehicle door lock (1) having a fork (2) which rotates about a first axis (A) between a release position and at least one lock position engaging a fixed striker (15), and a latch (3) which rotates about a second axis (B), is loaded elastically towards the fork (2), and has a catch portion (25) which clicks onto a tooth (11) of the fork (2) to lock the fork (2) releasably in the lock position. The fork (2) is defined by a main body (6) made of rigid material, and by an outer coating (7) made of relatively yielding material and having, adjacent to the tooth (11), a slot (33) defining a peripheral edge (34) which flexes inwards of the slot (33) when struck by the catch portion (25) of the latch (3) engaging the tooth (11) of the fork (2). The main body (6) has a recess (36) close to the root of the tooth (11); and the slot (33) is at least partly superimposed over the recess (36) to allow the peripheral edge (34) to flex inwards of the slot (33) wherever the catch portion (25) of the latch (3) strikes the fork (2).

7 Claims, 3 Drawing Sheets

VEHICLE DOOR LOCK

FIELD OF THE INVENTION

The present invention relates to a vehicle door lock for an automotive vehicle.

BACKGROUND OF THE INVENTION

As is known, vehicle door locks normally comprise a supporting body fixed to a door of the vehicle and a lock mechanism fitted to the supporting body and which engages a striker integral with a door post.

The lock mechanism substantially comprises a fork hinged to the supporting body about a fixed first pin and loaded elastically into a release position, and a latch hinged to the supporting body about a fixed second pin and pushed elastically so that a catch portion of it clicks onto a peripheral edge of the fork.

More specifically, the fork comprises a main body, normally in the form of a metal plate, which defines a C-shaped seat for engaging a normally cylindrical portion of the striker, and comprises two lateral shoulders or teeth which engage the catch portion of the latch. A first tooth is contiguous to the seat, while the second tooth is located on the opposite side of the first tooth to the seat.

A coating, normally of plastic material, covers the main body, so that the teeth project outwards of the coating and, between the two teeth, the coating defines a peripheral guide surface for the catch portion of the latch.

The fork rotates between the release position, in which the seat is oriented to permit insertion and withdrawal of the cylindrical portion of the striker, and a full-lock position, in which the cylindrical portion of the striker engages and is prevented from withdrawing from the seat.

More specifically, in the release position, the fork keeps the catch portion of the latch resting on a peripheral edge portion of the fork located on the opposite side of the second tooth to the first tooth.

The full-lock position of the fork is maintained stably by the catch portion of the latch clicking onto the first tooth of the fork.

In one typical, widely used solution, the fork can also be set to a partial-lock position interposed angularly between the release position and the full-lock position, and in which the cylindrical portion of the striker engages and is prevented from withdrawing from the seat. The partial-lock position of the fork is maintained by the catch portion of the latch engaging the second tooth of the fork. The force by which the cylindrical portion of the striker is retained inside the seat of the fork is obviously greater in the full-lock than in the partial-lock position.

The full-lock position is established when sufficient force is applied to the door to push the striker against the fork forcefully enough to move both teeth past the catch portion of the latch and to arrest the catch portion against the first tooth.

More specifically, as the fork rotates, the peripheral edge of the fork slides on the catch portion of the latch; and, as soon as the second tooth moves past the catch portion, the elastically loaded latch rotates towards the fork, contacts the guide surface at an intermediate point between the two teeth, and eventually clicks onto the first tooth.

The catch portion of the latch contacting the guide surface of the fork produces impact and, therefore, noise. To reduce the noise, the coatings of known forks have, at the intermediate portion of the guide surface portion between the two teeth, a through cavity bounded towards the latch by a flexible edge. When the catch portion of the latch contacts the guide surface, the flexible edge of the cavity therefore flexes inwards of the cavity, and is followed by the guide surface, thus damping impact and reducing noise.

As regards to reducing latch-impact-induced noise, known forks only function satisfactorily when moving into the standard full-lock position. If insufficient force is applied to close the door, the fork may stop in the partial-lock position, thus resulting in non-damped impact and noise.

SUMMARY OF THE INVENTION

It is an object of the present invention to provide a vehicle door lock designed to eliminate, in a straightforward, low-cost manner, the aforementioned drawback typically associated with known locks.

According to the present invention, there is provided a vehicle door lock, releasably connectable to a striker and comprising a fork which rotates about a first axis between a release position and at least one lock position engaging the striker. A latch, elastically loaded towards the fork, rotates about a second axis and has a catch portion which clicks into a tooth of the fork to releasably lock the fork in the lock position. The fork comprises a main body made of rigid material and an outer coating made of relatively yielding material. The fork further comprises a slot adjacent the tooth and defining a peripheral edge which flexes inwards of the slot when struck by the catch portion of the latch engaging the tooth of the fork. The main body comprises a recess close to the root of the tooth wherein the slot is at least partly superimposed over the recess to allow the edge to flex inwards of the slot whenever the catch portion of the latch strikes the fork.

BRIEF DESCRIPTION OF THE DRAWINGS

Other advantages of the present invention will be readily appreciated as the same becomes better understood by reference to the following detailed description when considered in connection with the accompanying drawings, wherein.

DETAILED DESCRIPTION OF THE PREFERRED EMBODIMENT

Figure 2:
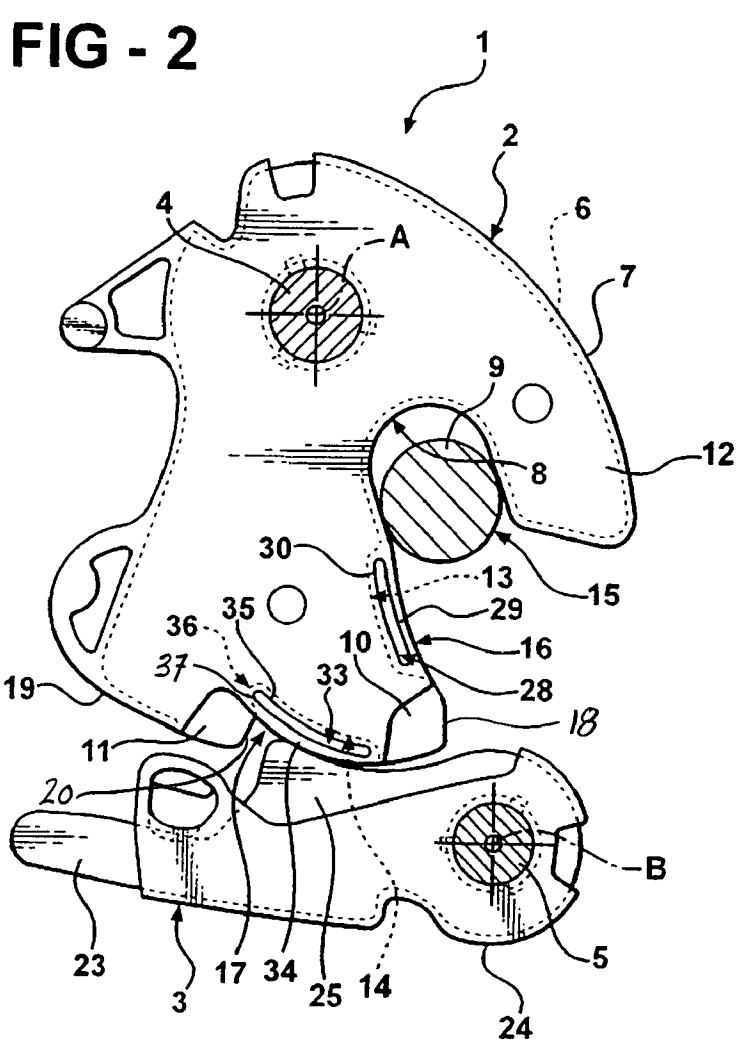
FIG. 2 is a partially sectioned top plan view of the lock of FIG. 1 moving into a lock position.

Referring to FIGS. 1 to 4, a vehicle door lock is shown at 1 for a door of an automotive vehicle. It should be appreciated that the term "door" is used in its broadest sense to indicate any member movable between an open and closed position to open and close an access opening in an internal compartment of a vehicle, and therefore, includes hoods and rear doors or lift gates, in addition to the vehicle side doors referred to herein purely by way of example.

Lock 1 substantially comprises a fork 2 and a latch 3 hinged about respective fixed pins 4, 5 having respective parallel axes A, B. More specifically, fork 2 is defined by a contoured plate 6 made of rigid material, e.g. metal, and lying in a plane perpendicular to axis A; and by a coating 7 made of relatively yielding material, e.g. plastic, and covering plate 6.

Plate 6 (shown without coating 7 in FIG. 5) comprises a C-shaped peripheral seat 8 for receiving a cylindrical portion 9 of a striker 15 (known and only illustrated as necessary for a clear understanding of the present invention); and three teeth 10, 11, 12, two (10, 11) of which define respective shoulders which click onto latch 3, as explained in further detail herein below. More specifically, seat 8 is bounded laterally by teeth 10 and 12, and tooth 11 is located on the opposite side of tooth 10 to tooth 12.

Coating 7 covers plate 6 so that both teeth 10 and 11 cooperating with latch 3 project from the peripheral edge of fork 2.

Figure 1:
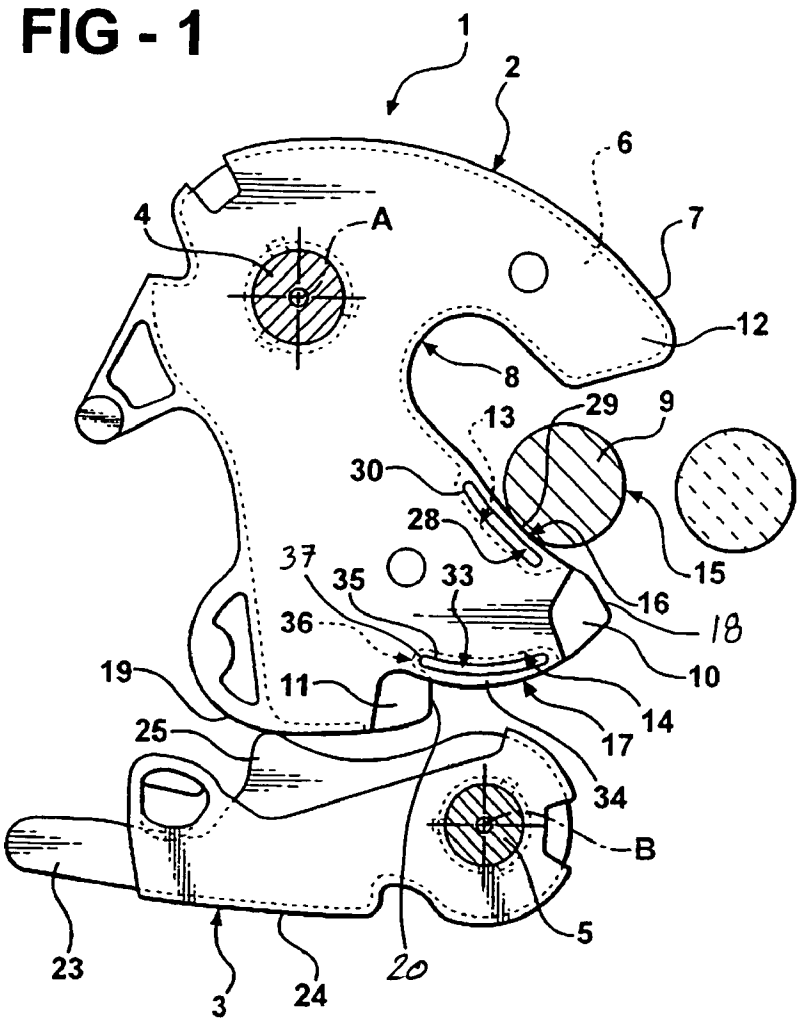
FIG. 1 is a partially sectioned top plan view of a vehicle door lock in a release position.

Fork 2 is pushed, or biased, by a known spring (not shown) into a release position, as shown in FIG. 1, in which the open side of seat 8 faces the insertion/withdrawal direction of portion 9 of striker 15, and so permits connection/release of striker 15 and lock 1.

Figure 4:
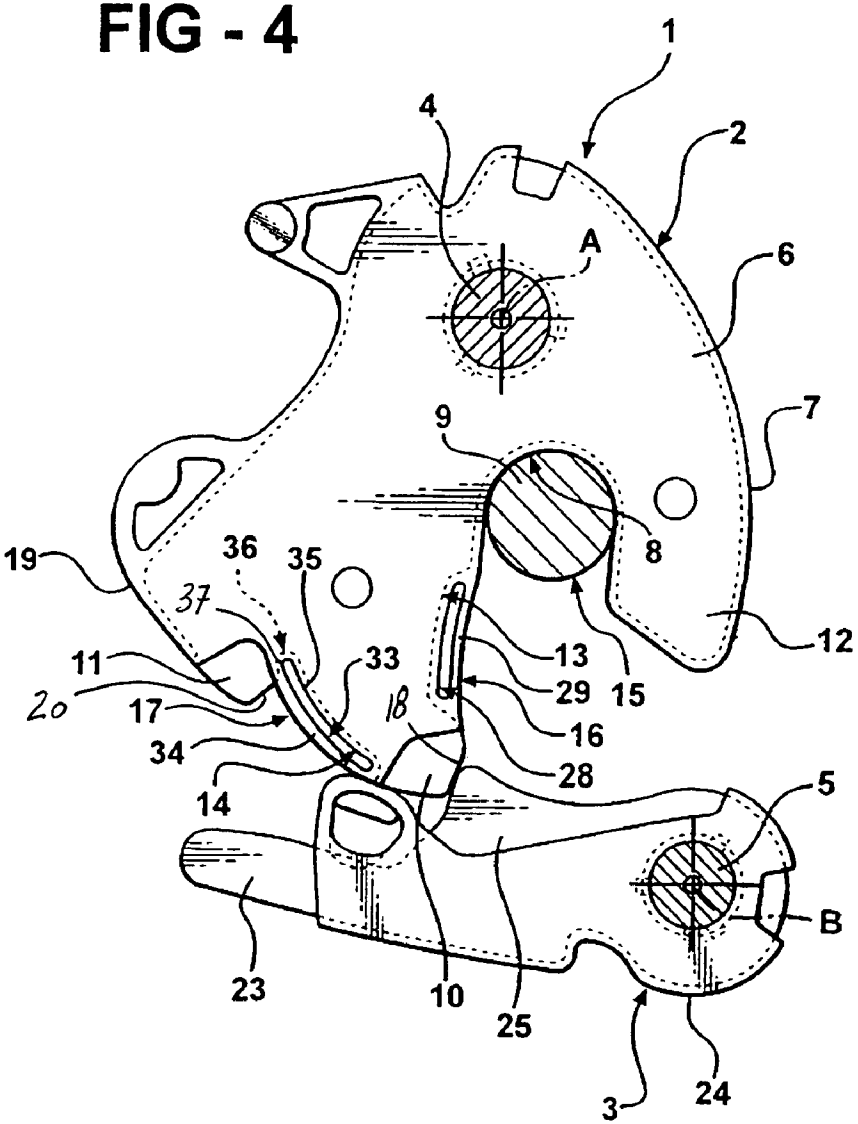
FIG. 4 is a partially sectioned top plan view of the lock of FIG. 1 in a full-lock position.
Figure 3:
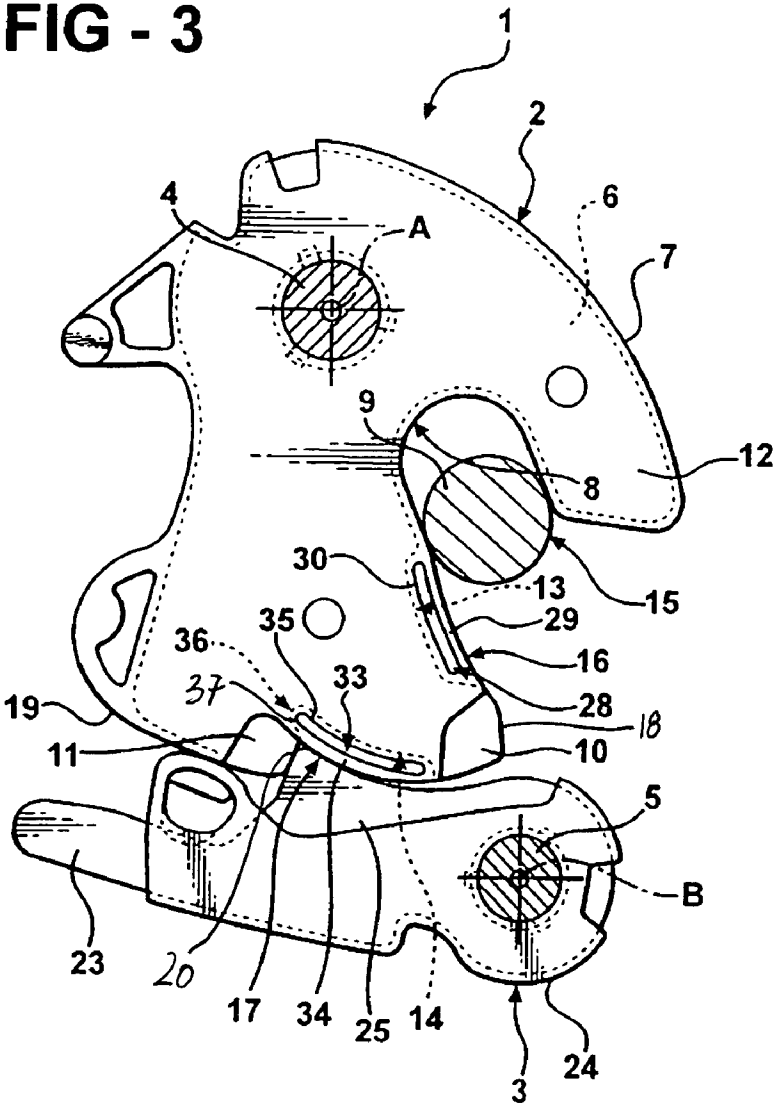
FIG. 3 is a partially sectioned top plan view of the lock of FIG. 1 in a partial-lock position.

When the door is slammed, portion 9 of striker 15 rotates fork 2 clockwise about axis A to click onto latch 3 in a full-lock position, FIG. 4, and a partial-lock position, FIG. 3, between the release position and the full-lock position, in which striker 15 is locked inside seat 8 and prevented in known manner from withdrawing by tooth 12.

As shown in FIGS. 1-4, latch 3 is defined by a contoured plate 23 made of rigid material, e.g. metal, and substantially coplanar with fork 2; and by a coating 24 conveniently of relatively yielding material, e.g. plastic. Latch 3 is pushed, or biased, by a known spring (not shown) towards the peripheral edge of fork 2.

More specifically, latch 3 has an L-shaped end edge defining a catch portion 25, which cooperates with the peripheral edge of fork 2, when fork 2 is in the release position, and clicks onto a face 18 of tooth 10 or a face 20 of tooth 11 to releasably lock fork 2 in the full-lock position, FIG. 4, or partial-lock position, FIG. 3, respectively. Otherwise, when fork 2 is in the release position, latch 3 is positioned with catch portion 25 resting on a peripheral edge portion 19 of fork 2 located on the opposite side of tooth 11 to tooth 10, as shown in FIG. 1.

Figure 5:
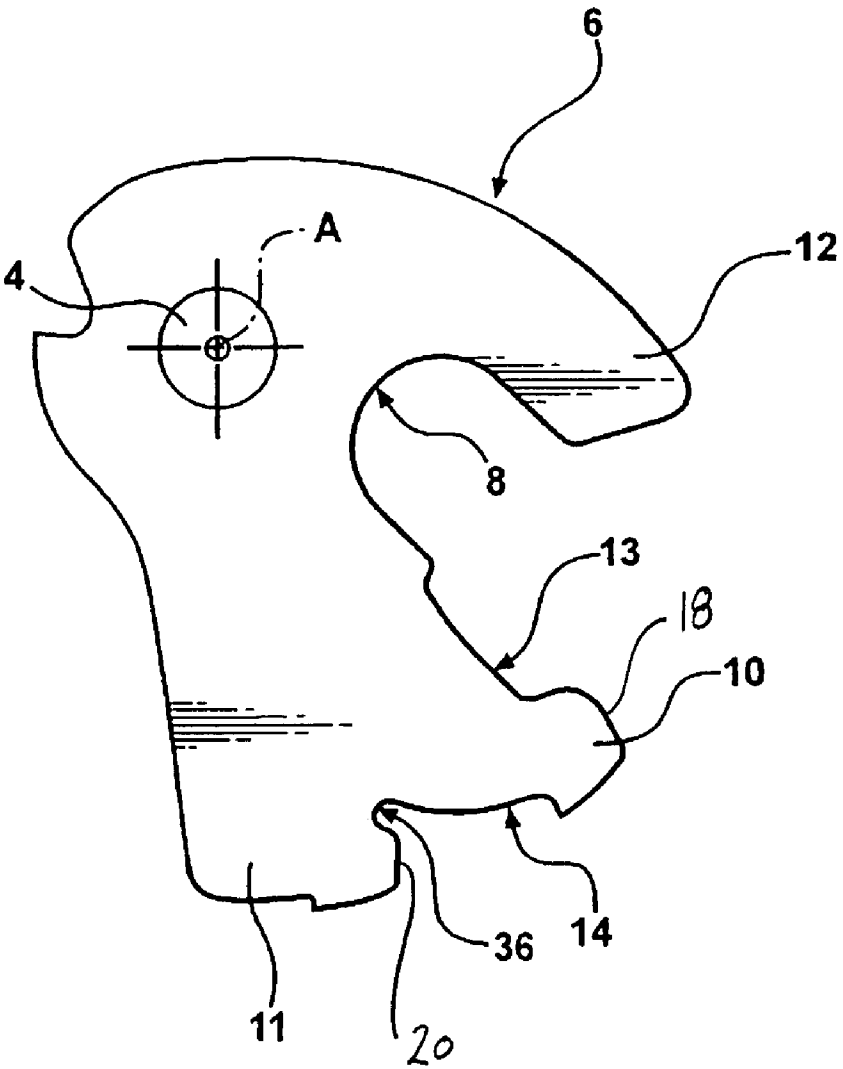
FIG. 5 is a partially sectioned top plan view of a fork forming part of the lock shown in the accompanying drawings, and from which the coating has been removed.

As shown in FIGS. 1-4, and in FIG. 5 showing fork 2 without coating 7, tooth 10 is connected peripherally to the bottom of seat 8 by a first recessed surface 13, and to tooth 11 by a second recessed surface 14. At recessed surfaces 13 and 14 of plate 6, coating 7 comprises respective elongated slots 28, 33 peripherally defining respective flexible edges 29, 34, which, upon impact of portion 9 of striker 15 and catch portion 25 of latch 3 respectively, flex inwards of slots 28, 33, and therefore towards relative recessed surfaces 13, 14, to attenuate impact-induced noise.

More specifically, slot 28 is bounded, on the opposite side to flexible edge 29, by an edge 30 parallel to edge 29, connected at opposite ends to edge 29, and secured rigidly to recessed surface 13 of plate 6. Flexible edge 29 defines a guide surface 16 which cooperates with portion 9 of striker 15 when closing the door.

Similarly, slot 33 is bounded, on the opposite side to flexible edge 34, by an edge 35 parallel to edge 34, connected at opposite ends to edge 34, and secured rigidly to recessed surface 14 of plate 6. Flexible edge 34 defines a guide surface 17 which cooperates with catch portion 25 of latch 3 when closing the door.

According to an important aspect of the present invention, plate 6 of fork 2 has a recess 36 (shown clearly in FIG. 5) at the root of tooth 11, and slot 33 of coating 7 extends over recess 36 to allow edge 34 to flex inwards of slot 33 wherever latch 3 contacts the peripheral edge of fork 2. More specifically, the recess 36 at the root of tooth 11 extends into the tooth 11 past the tooth face 20, thereby defining an undercut, and the slot 33 has an end portion 37 contained inside the recess 36 in the tooth 11.

In actual use, lock 1 is engaged, from inside or outside the vehicle, by simply slamming the door, so that portion 9 of striker 15 strikes guide surface 16 of fork 2, and so rotates fork 2 clockwise from the release position shown in FIG. 1, to the partial-lock and full-lock positions, shown in FIGS. 3 and 4, respectively.

Impact of portion 9 of striker 15 on guide surface 16 flexes edge 29 of coating 7 inwards of slot 28, thus reducing impact and noise.

Rotation of fork 2 first causes portion 19 of the fork 2 to slide on catch portion 25 of latch 3; and, as soon as second tooth 11 moves past catch portion 25, latch 3, which is loaded elastically towards fork 2, is rotated towards fork 2 and into contact with guide surface 17.

Fork 2 can be locked by latch 3 in both the full-lock position and the partial-lock position, depending on the force exerted on the door. In both the full- and partial-lock positions, withdrawal of striker 15 from seat 8 of fork 2 is prevented by tooth 12, which, is positioned in known manner crosswise to the insertion/withdrawal direction of striker 15.

More specifically, the full-lock position is established when the force exerted on the door pushes fork 2 sufficiently to move both teeth 10 and 11 past catch portion 25 of latch 3, so that catch portion 25 clicks onto tooth 10, thus preventing fork 2 from springing back to the release position, as shown in FIG. 4.

In this case, catch portion 25 strikes guide surface 17 at a substantially intermediate point between teeth 10 and 11, thus flexing edge 34 inwards of slot 33 and so reducing impact and noise.

Conversely, the partial-lock position is established when the force exerted on the door only pushes fork 2 sufficiently to move tooth 11 past catch portion 25 of latch 3. In this case, catch portion 25 of latch 3 strikes guide surface 17 close to tooth 11, as shown in FIG. 2. Thanks to the provision of recess 36, edge 34, in this case too, is able to flex inwards of slot 33 to reduce the impact, and therefore noise, of latch 3 on fork 2.

Following impact as described above, and when the thrust imparted by the user is no longer effective, fork 2 springs back towards the release position (rotating counter-clockwise in the drawings), so that the portion of guide surface 17 adjacent to tooth 11 slides on catch portion 25, and catch portion 25 is eventually arrested against tooth 11, as shown in FIG. 3.

The advantages of lock 1 according to the present invention will be clear from the foregoing description.

In particular, recess 36 at the root of tooth 11 extends slot 33 further inwards with respect to tooth 11, so that edge 34 is flexible at any point along the peripheral edge portion 34 of fork 2 between teeth 10 and 11.

Lock 1 is therefore silent-operating, even when little force is exerted on the door, by edge 34 being allowed to flex inwards of slot 33, thus attenuating the noise produced by catch portion 25 of latch 3 striking guide surface 17 close to tooth 11. Clearly, changes may be made to lock 1 as described and illustrated herein without, however, departing from the scope of the invention.

What is claimed is:

1. A vehicle door lock (1) releasably connectable to a striker (15) and comprising a fork (2) which rotates about a first axis (A) between a release position and at least one lock position engaging the striker (15), and a latch (3) which rotates about a second axis (B), is loaded elastically towards said fork (2), and has a catch portion (25) which clicks onto a tooth (11) of said fork (2) to releasably lock said fork (2) in said lock position; said fork (2) comprising a main body (6) made of rigid material, and an outer coating (7) made of relatively yielding material and having, adjacent to said tooth (11), an enclosed slot (33) defining a peripheral edge (34) which flexes inwards of said slot (33) when struck by said catch portion (25) of said latch (3) engaging said tooth (11) of said fork (2);

characterized in that said main body (6) comprises a recessed surface (14) adjacent to said tooth (11) having a generally U-shaped recess (36) at the root of said tooth (11), said recess (36) extending into said tooth (11); wherein said enclosed slot (33) is disposed along said recessed surface (14) and extends at least partly into said recess (36) to allow said edge (34) to flex inwards of said enclosed slot (33) wherever said catch portion (25) of said latch (3) strikes said fork (2).

2. A lock as set forth in claim 1, further characterized in that said fork (2) can be set to two distinct, respectively, partial and full, lock positions; said partial-lock position being defined by said tooth (11) and being interposed between said release position and said full-lock position as said fork (2) travels from said release position.

3. A lock as set forth in claim 2, further characterized in that said slot (33) is elongated defining a continuous and elongated peripheral edge (34), and wherein said elongated slot (33) comprises an end portion (37) contained inside said recess (36).

4. A lock as set forth in claim 3, further characterized by said fork including a second slot (28) defining a peripheral edge (29) which flexes inwards of said slot (28) when struck by the striker (15) to actuate said lock (1) between said release position and one of said partial-lock and full lock positions.

5. A lock as set forth in claim 4, further characterized by said fork (2) including a generally C-shaped seat (8) for receiving and retaining the striker (15) therein in each of said partial-lock and full lock positions.

6. A vehicle door lock (1) releasably connectable to a striker (15) comprising:

a fork (2) rotatably coupled to said door lock (1) for rotation about a first axis (A) between a release position and at least one lock position engaging the striker (15), said fork (2) including a main body (6) having a tooth (11) and a recessed surface (14), said tooth (11) defining a tooth face (20), said recessed surface (14) adjacent to said tooth (11) and including an undercut (36) at the root of said tooth (11) extending into said tooth (11) past said tooth face (20);

a latch (3) rotatably coupled to said door lock (1) for rotation about a second axis (B), said latch (3) loaded elastically towards said fork (2), and including a catch portion (25) for engaging said tooth face (20) of said tooth (11) to releasably lock said fork (2) in said lock position; and wherein said fork (2) includes an outer coating (7) made of relatively yielding material, said outer coating (7) defining an enclosed slot (33) extending along said recessed surface (14) and at least partly into said undercut (36), said enclosed slot (33) having a peripheral edge (34), wherein said peripheral edge (34) flexes inwards of said enclosed slot (33) when struck by said catch portion (25) of said latch (3).

7. A vehicle door lock (1) releasably connectable to a striker (15) comprising:

a fork (2) rotatably coupled to said door lock (1) for rotation about a first axis (A) between a release position and at least one lock position engaging the striker (15), said fork (2) including a main body (6) having a first tooth (10) disposed between a second tooth (11) and a third tooth (12), said first tooth (10) and said third tooth (12) defining a seat (8) for receiving the striker (15), a first recessed surface (13) extending along said first tooth (10) adjacent said seat (8), a second recessed surface (14) extending along said first tooth (10) adjacent said second tooth (11), said second recessed surface (14) including an undercut (36) at the root of said second tooth (11) extending into said second tooth (11) past a tooth face (20);

a latch (3) rotatably coupled to said door lock (1) for rotation about a second axis (B), said latch (3) loaded elastically towards said fork (2), and including a catch portion (25) for engaging said tooth face (20) of said second tooth (11) to releasably lock said fork (2) in said lock position; and wherein said fork (2) includes an outer coating (7) made of relatively yielding material, said outer coating (7) defining an enclosed slot (33) extending along said recessed surface (14) and including an end portion (37) contained inside said undercut (36), said enclosed slot (33) having a peripheral edge (34), wherein said peripheral edge (34) flexes inwards of said enclosed slot (33) when struck by said catch portion (25) of said latch (3).

* * * * *